US007969399B2

(12) United States Patent
Hosotani

(10) Patent No.: US 7,969,399 B2
(45) Date of Patent: Jun. 28, 2011

(54) LIQUID CRYSTAL DISPLAY DEVICE, DRIVING CIRCUIT FOR THE SAME AND DRIVING METHOD FOR THE SAME

(75) Inventor: Yukihiko Hosotani, Suzuka (JP)

(73) Assignee: Sharp Kabushiki Kaisha, Abeno-ku, Osaka (JP)

( * ) Notice: Subject to any disclaimer, the term of this patent is extended or adjusted under 35 U.S.C. 154(b) by 752 days.

(21) Appl. No.: 10/990,456

(22) Filed: Nov. 18, 2004

(65) Prior Publication Data

US 2005/0110737 A1 May 26, 2005

(30) Foreign Application Priority Data

Nov. 21, 2003 (JP) ..... 2003-391769

(51) Int. Cl.
*G09G 3/36* (2006.01)

(52) U.S. Cl. ..... 345/98; 345/90; 345/95

(58) Field of Classification Search ..... 345/96, 345/86, 87, 88, 100, 90, 95, 98
See application file for complete search history.

(56) References Cited

U.S. PATENT DOCUMENTS

| | | | | |
|---|---|---|---|---|
| 6,674,421 | B2 * | 1/2004 | Mori et al. | 345/96 |
| 6,784,861 | B2 * | 8/2004 | Okada | 345/87 |
| 7,209,106 | B2 * | 4/2007 | Lu et al. | 345/89 |
| 2001/0043178 | A1 * | 11/2001 | Okuzono et al. | 345/87 |
| 2002/0024482 | A1 * | 2/2002 | Song et al. | 345/87 |
| 2004/0001039 | A1 * | 1/2004 | Shino et al. | 345/100 |

FOREIGN PATENT DOCUMENTS

| | | |
|---|---|---|
| JP | 08-043795 | 2/1996 |
| JP | 9-15560 | 1/1997 |
| JP | 2000-019484 | 1/2000 |
| JP | 2001-013480 | 1/2001 |
| JP | 2002-108288 A | 4/2002 |
| JP | 2003-066928 | 3/2003 |

* cited by examiner

*Primary Examiner* — Quan-Zhen Wang
*Assistant Examiner* — Calvin C Ma
(74) *Attorney, Agent, or Firm* — Harness, Dickey & Pierce, PLC

(57) ABSTRACT

A horizontal scanning period correction value setting circuit compares a video signal representing a display image of pixel formation portions of polarity-inverted lines and a video signal representing a display image of pixel formation portions of the next row, and generates a signal width correction value for correcting the length of the horizontal scanning period. For this, the signal width correction value is set such that the charge ratios of the pixel formation portions are constant, regardless of a difference between a target voltage of the driving video signals when the polarity is inverted and a target voltage of the driving video signals when the polarity is sustained. Then, a source output control signal and a gate output control signal are generated based on the signal width correction value, and the scanning signals and the driving video signals are generated based on the source output control signal and the gate output control signal.

9 Claims, 10 Drawing Sheets

CK
PULSE NUMBER
OF CK = N
PULSE NUMBER
OF CK = N

Cs
PULSE NUMBER
OF CK = N+2
PULSE NUMBER
OF CK = N-2

Cs(P=2)

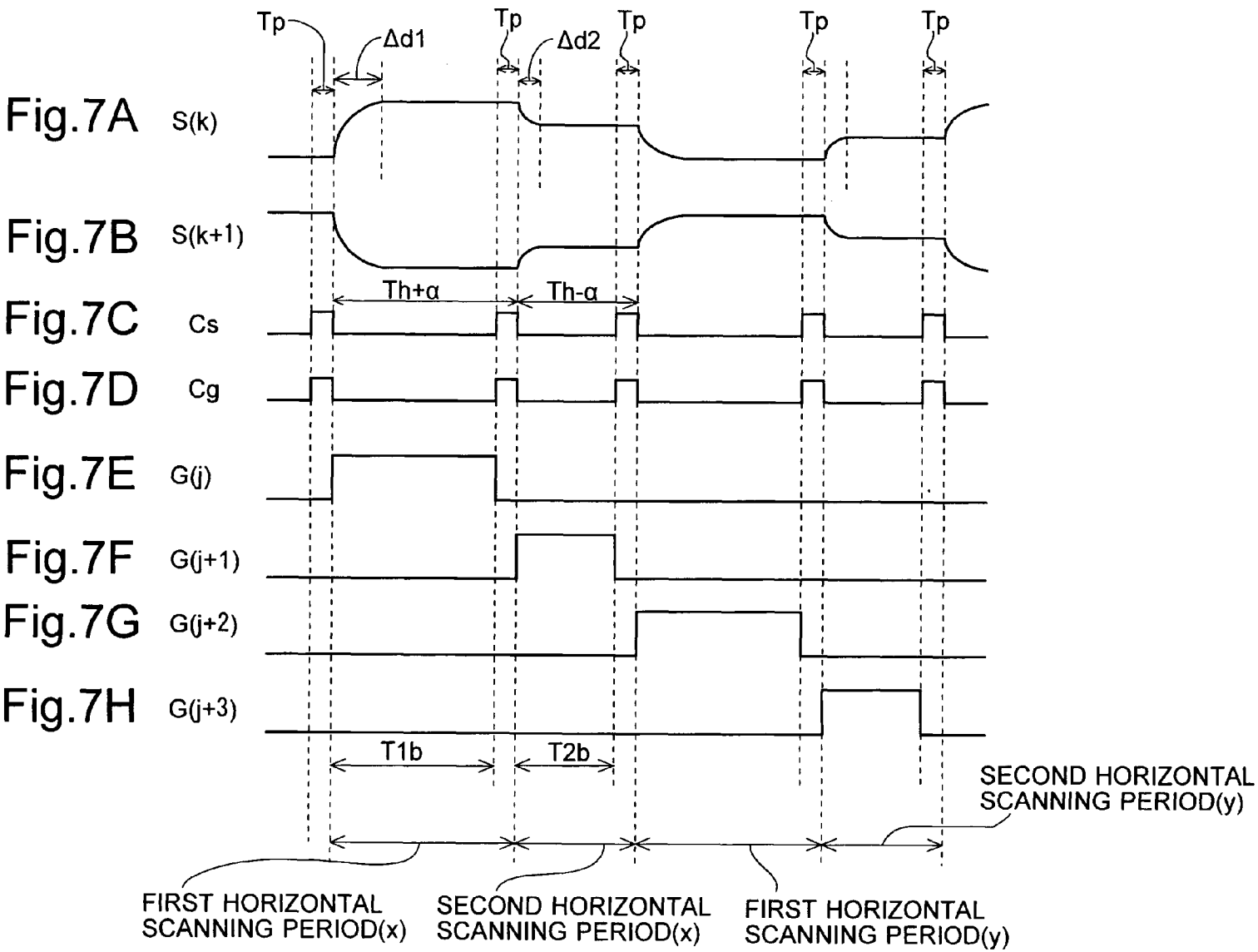
Fig.7A S(k)
Fig.7B S(k+1)
Fig.7C Cs
Fig.7D Cg
Fig.7E G(j)
Fig.7F G(j+1)
Fig.7G G(j+2)
Fig.7H G(j+3)
Tp
Δd1
Δd2
Th+α
Th-α
T1b
T2b
FIRST HORIZONTAL SCANNING PERIOD(x)
SECOND HORIZONTAL SCANNING PERIOD(x)
FIRST HORIZONTAL SCANNING PERIOD(y)
SECOND HORIZONTAL SCANNING PERIOD(y)

Fig.10A
PRIOR ART

| | | | |
|---|---|---|---|
| + | + | + | + |
| − | − | − | − |
| + | + | + | + |
| − | − | − | − |

Fig.10B
PRIOR ART

| | | | |
|---|---|---|---|
| + | − | + | − |
| − | + | − | + |
| + | − | + | − |
| − | + | − | + |

Fig.10C
PRIOR ART

| | | | |
|---|---|---|---|
| + | − | + | − |
| + | − | + | − |
| − | + | − | + |
| − | + | − | + |

LIQUID CRYSTAL DISPLAY DEVICE, DRIVING CIRCUIT FOR THE SAME AND DRIVING METHOD FOR THE SAME

CROSS REFERENCE TO RELATED APPLICATIONS

This application claims priority under 35 U.S.C. §119(a) upon Japanese Patent Application No. 2003-391769 titled "LIQUID CRYSTAL DISPLAY DEVICE, DRIVING CIRCUIT AND DRIVING METHOD FOR THE SAME," filed on Nov. 21, 2003, the entire content of which is hereby incorporated by reference.

BACKGROUND OF THE INVENTION

1. Field of the Invention

The present invention relates to driving circuits and driving methods for liquid crystal display devices, and in particular to multiple line inversion driving in active matrix liquid crystal display devices.

2. Description of the Related Art

Active matrix liquid crystal display devices provided with TFTs (thin film transistors) as switching elements have been known for several years. Such liquid crystal display devices are provided with a liquid crystal panel which includes two insulating substrates that are arranged opposite one another. On one substrate of the liquid crystal panel, scanning signal lines and video signal lines are arranged in a lattice, and TFTs are arranged near the intersections of the scanning signal lines and the video signal lines. Each of the TFTs has a drain electrode, a gate electrode branching off from the scanning signal lines, and a source electrode branching off from the video signal lines. The drain electrodes are connected to pixel electrodes that are arranged in a matrix on the substrate for forming an image. Also, the substrate on the other side of the liquid crystal panel is provided with an opposing electrode for applying a voltage between the pixel electrodes and the opposing electrode, across the liquid crystal layer. The individual pixels are formed by the pixel electrodes, the opposing electrode and the liquid crystal layer. It should be noted that, for the sake of convenience, regions forming single pixels are referred to as "pixel formation portions". Moreover, a voltage is applied to the pixel formation portions based on a video signal that the source electrodes of the TFTs receive from the video signal lines when the gate electrodes of the TFTs receive an active scanning signal from the scanning signal lines. At each of the pixel formation portions, a pixel capacitance is formed by the pixel electrode and the opposing electrode, and the pixel capacitance holds a voltage indicating the pixel value.

Now, the liquid crystal has the property of degrading when a DC voltage is applied to it continuously. Therefore, an AC voltage is applied to the liquid crystal layer in the liquid crystal display device. This application of the AC voltage to the liquid crystal layer can be realized by inverting the polarity of the voltage applied to each of the pixel formation portions in every single frame period, that is, by inverting in every single frame period the polarity of the voltage of the source electrode (video signal voltage) when taking the voltage of the opposing electrode as the reference. As technologies for realizing this, a driving method known as line inversion driving and a driving method known as dot inversion driving are known. It should be noted that in the following, the voltage applied to the pixel formation portions is referred to as "pixel voltage".

In line inversion driving, the polarity of the pixel voltage is inverted in every single frame period and at every predetermined number of signal scanning lines. For example, a driving method in which the polarity of the pixel voltage is inverted in every single frame period and at every two scanning signal lines is referred to as "2-line inversion driving". On the other hand, in dot inversion driving, the polarity of the pixel voltage is inverted in every single frame period, and also the polarities of pixels that are adjacent in the horizontal direction are inverted within a single frame period.

FIGS. 10A to 10C are polarity diagrams showing the polarities of the pixel voltages applied to the pixel formation portions on the display screen for a given frame period in a conventional liquid crystal display device. It should be noted that FIGS. 10A-C show the polarities only for a portion (four rows×four columns) of the display screen. FIG. 10A shows the polarities for the case of 1-line inversion driving. As shown in FIG. 10A, in the direction in which the scanning signal lines extend, the polarities of all of the pixel formation portions are the same. On the other hand, in the direction in which the video signal lines extend, the polarities of the pixel formation portions are inverted at every single pixel formation portion.

It is difficult to make the transmittance of the liquid crystal when the polarity of the pixel voltage is positive the same as the transmittance of the liquid crystal when the polarity of the pixel voltage is negative. The reason for this is, for example, that the on-current of the TFT differs depending on whether the polarity of the pixel voltage is positive or negative. For this reason, a pattern of horizontal lines tends to be perceivable in the case of the above-described 1-line inversion driving, for example when a uniform luminance is displayed on the entire display screen.

FIG. 10B shows the polarities for the case of dot inversion driving. As shown in FIG. 10B, in dot inversion driving, the polarities of the pixel voltages are inverted at all neighboring pixels, so that the above-noted problem does not occur. However, with conventional dot inversion driving, the polarity of the pixel voltages is inverted at every single scanning signal line, so that there is the problem that the power consumption is large.

In order to solve this problem, JP H08-43795A discloses a liquid crystal display device, in which the polarities of the pixel voltages are inverted at every two scanning signal lines and the polarities are also inverted between pixels adjacent in the horizontal direction. FIG. 10C shows the polarities of the pixel voltages of this liquid crystal device. With this liquid crystal device, the polarities are inverted between pixels adjacent in the horizontal direction, thus solving the problem that occurs in the case of line inversion driving. Moreover, the polarities of the pixel voltages are inverted at every two scanning signal lines, so that the power consumption is lower than in the case of inverting at every signal scanning signal line. It should be noted that the driving method of this liquid crystal display device is also referred to as "2-line dot inversion driving".

In recent years, however, the resolution of liquid crystal display devices is becoming increasingly higher, and the number of scanning signal lines in the device is steadily increasing. Therefore, the length of the horizontal scanning period is becoming shorter, and the time for accumulating charges in the pixel capacitances (charge time) may not be sufficient. Moreover, as liquid crystal display devices become larger, also the rise time until the voltage of the source electrodes of the TFTs have reached a target voltage with the video signals becomes longer. FIGS. 11A to 11E are signal waveform diagrams for the case of the above-described 2-line dot inversion driving. FIG. 11A shows the signal waveform of the video signal S(k) of the k-th column. FIG. 11B shows the signal waveform of the scanning signal G(j) of the j-th row. FIG. 11C shows the signal waveform of the scanning signal G(j+1) of the (j+1)-th row. FIG. 11D shows the signal waveform of the scanning signal G(j+2) of the (j+2)-th row. FIG. 11E shows the signal waveform of the scanning signal G(j+3) of the (j+3)-th row. T1 through T4 each denote one horizontal scanning period. As shown in FIGS. 11B to 11E, the scanning signals are successively made active in the direction in which the video signal lines extend. Also, the time of the active state (pulse width) is the same for all scanning signals G(j) to G(j+3). In this case, for the reasons explained above, a sufficient charge may not be accumulated in the pixel capacitances of the pixel formation portions to which a video signal S(k) is supplied whose polarity is inverted from the previous horizontal scanning period, as in the periods T1 or T3, so that only a pixel potential that is lower than the desired gray-scale potential is attained. On the other hand, in the pixel formation portions to which a video signal S(k) is supplied whose polarity is the same as in the previous horizontal scanning period, as in the periods T2 or T4, the signal voltage is already at a sufficiently high potential, so that sufficient charges accumulate in the pixel capacitances. Therefore, the charge amount accumulated in the pixel capacitances differs between the pixel formation portions to which a video signal is supplied whose polarity is inverted from the previous horizontal scanning period and the pixel formation portions to which a video signal is supplied whose polarity is the same as in the previous horizontal scanning period, which may cause a decrease in display quality. For example, when displaying a uniform luminance on the entire screen, a pattern of horizontal lines appears on the screen. It should be noted that in the following, the ratio of the actual pixel potential of a given pixel formation portion to the desired gray-scale potential of that pixel formation portion is referred to as "charge ratio."

SUMMARY OF THE INVENTION

It is thus an object of the present invention to provide a liquid crystal display device whose driving method is multiple-line inversion driving, such as 2-line inversion driving, preventing a decrease of the display quality caused by a delay of the rise time of the video signal or an insufficient pixel capacitance charge time, due to making the display device larger or providing it with a higher resolution.

According to a first aspect of the present invention, a driving circuit of an active matrix liquid crystal display device comprising a plurality of video signal lines for transmitting a plurality of video signals representing an image to be displayed, a plurality of scanning signal lines intersecting the plurality of video signal lines, and a plurality of pixel formation portions that are arranged in a matrix in correspondence with intersections of the plurality of video signal lines and the plurality of scanning signal lines, comprises:

a video signal line driving circuit for supplying the video signals to the plurality of video signal lines such that, within a single frame period, the polarities of voltages applied to the pixel formation portions are inverted at every predetermined number of scanning signal lines, the predetermined number being at least 2;

a scanning signal line driving circuit for selectively driving the plurality of scanning signal lines; and a signal width setting circuit for setting a first signal width representing a period during which an output of the video signals is used to charge one pixel formation portion when an active scanning signal is supplied to a first scanning signal line of the predetermined number of scanning signal lines and a second signal width representing a period during which an output of the video signals is used to charge one pixel formation portion when an active scanning signal is supplied to a second or further scanning signal line of the predetermined number of scanning signal lines;

wherein the video signal line driving circuit generates the video signals based on the first signal width and the second signal width;

wherein the scanning signal line driving circuit generates a scanning signal that becomes active in accordance with the first signal width and the second signal width; and wherein the first signal width is set to a larger width than the second signal width.

With this configuration, the horizontal scanning periods in which video signals with inverted polarity are supplied become longer than the horizontal scanning periods in which video signals with sustained polarity are supplied. Thus, differences in the charge ratios of pixel formation portions caused by polarity inversion of the video signals can be compensated. Therefore, a decrease of the display quality caused by insufficient charging of the pixel formation portions due to the polarity inversion can be suppressed.

In this driving circuit, it is preferable that the signal width setting circuit sets the first signal width and the second signal width such that a ratio of the pixel voltage at the pixel formation portions arranged in correspondence with the intersections of the first scanning signal line and the plurality of video signal lines to a first target pixel voltage, which is a pixel voltage taken as a target, when an active scanning signal is supplied to the first scanning signal line, is equal to a ratio of the pixel voltage at the pixel formation portions arranged in correspondence with the intersections of the second and further scanning signal lines and the plurality of video signal lines to a second target pixel voltage, which is a pixel voltage taken as a target, when an active scanning signal is supplied to the second and further scanning signal lines.

With this configuration, the length of the horizontal scanning periods are set such that the charge ratio of the pixel formation portions to which video signals with sustained polarity are supplied becomes the same as the charge ratio of the pixel formation portions to which video signals with inverted polarity are supplied. Thus, if the voltages of the video signals supplied to the pixel formation portion are the same, then the charge ratio of all pixel formation portions becomes the same, regardless of polarity inversion. Therefore, a decrease of the display quality, such as the occurrence of striped patterns during uniform display over the entire screen, which is caused by differences in the charge ratio of the pixel formation portions from scanning signal line to scanning signal line, can be suppressed.

According to another aspect of the present invention, an active matrix liquid crystal display device comprises:

a plurality of video signal lines for transmitting a plurality of video signals representing an image to be displayed;

a plurality of scanning signal lines intersecting the plurality of video signal lines;

a plurality of pixel formation portions that are arranged in a matrix in correspondence with intersections of the plurality of video signal lines and the plurality of scanning signal lines;

a video signal line driving circuit for supplying the video signals to the plurality of video signal lines such that, within a single frame period, the polarities of voltages applied to the pixel formation portions are inverted at every predetermined number of scanning signal lines, the predetermined number being at least 2;

a scanning signal line driving circuit for selectively driving the plurality of scanning signal lines; and a signal width setting circuit for setting a first signal width representing a period during which an output of the video signals is used to charge one pixel formation portion when an active scanning signal is supplied to a first scanning signal line of the predetermined number of scanning signal lines and a second signal width representing a period during which an output of the video signals is used to charge one pixel formation portion when an active scanning signal is supplied to a second or further scanning signal line of the predetermined number of scanning signal lines;

wherein the video signal line driving circuit generates the video signals based on the first signal width and the second signal width;

wherein the scanning signal line driving circuit generates a scanning signal that becomes active in accordance with the first signal width and the second signal width; and wherein the first signal width is set to a larger width than the second signal width.

According to yet another aspect of the present invention, a driving method for an active matrix liquid crystal display device comprising a plurality of video signal lines for transmitting a plurality of video signals representing an image to be displayed, a plurality of scanning signal lines intersecting the plurality of video signal lines, and a plurality of pixel formation portions that are arranged in a matrix in correspondence with intersections of the plurality of video signal lines and the plurality of scanning signal lines, comprises:

a video signal line driving step of supplying the video signals to the plurality of video signal lines such that, within a single frame period, the polarities of voltages applied to the pixel formation portions are inverted at every predetermined number of scanning signal lines, the predetermined number being at least 2;

a scanning signal line driving step of selectively driving the plurality of scanning signal lines; and a signal width setting step of setting a first signal width representing a period during which an output of the video signals is used to charge one pixel formation portion when an active scanning signal is supplied to a first scanning signal line of the predetermined number of scanning signal lines and a second signal width representing a period during which an output of the video signals is used to charge one pixel formation portion when an active scanning signal is supplied to a second or further scanning signal line of the predetermined number of scanning signal lines;

wherein the video signals are generated based on the first signal width and the second signal width;

wherein the scanning signals are generated based on the first signal width and the second signal width; and wherein the first signal width is set to a larger width than the second signal width.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 7A to 7H are signal waveform diagrams for the case that different luminances are displayed at each scanning signal line in the above-noted embodiment.

FIG. 10A is a polarity diagram showing the polarities of the pixel voltages of the pixel formation portions on a display screen in a conventional liquid crystal display device for the case of 1-line inversion driving.

FIG. 10B is a polarity diagram showing the polarities of the pixel voltages of the pixel formation portions on a display screen in a conventional liquid crystal display device for the case of dot inversion driving.

FIG. 10C is a polarity diagram showing the polarities of the pixel voltages of the pixel formation portions on a display screen in a conventional liquid crystal display device for the case of 2-line dot inversion driving.

DESCRIPTION OF THE PREFERRED EMBODIMENTS

The following is a description of embodiments of the present invention, with reference to the accompanying drawings. It should be noted that in the following, scanning signal lines to which a video signal is applied whose polarity is inverted from the previous horizontal scanning period are referred to, for convenience's sake, as "polarity-inverted lines" and the pixel formation portions arranged in correspondence to such a "polarity-inverted line" are referred to as "polarity-inverted pixels". On the other hand, scanning signal lines to which a video signal is applied whose polarity is the same as that of the previous horizontal scanning period are referred to as "polarity-sustained lines" and the pixel formation portions arranged in correspondence to such a "polarity-sustained line" are referred to as "polarity-sustained pixels". Moreover, the horizontal scanning period immediately after the polarity inversion is referred to as "first horizontal scanning period", and the next horizontal scanning period is referred to as "second horizontal scanning period". Furthermore, the period for which the output of the video signal for one pixel formation portion is held is represented by "signal width".

1. Configuration of Liquid Crystal Display Device

Figure 1:
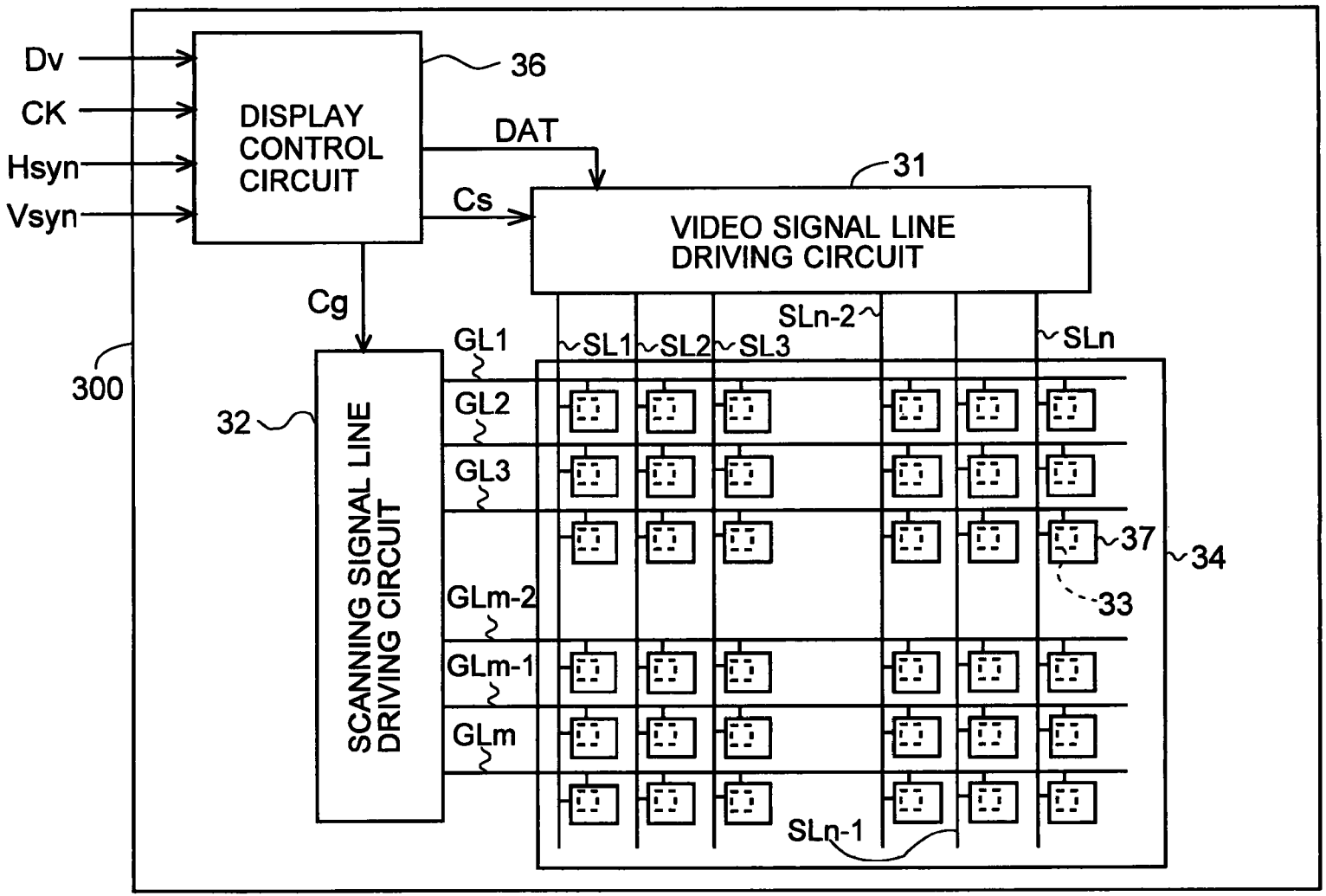
FIG. 1 is a block diagram showing the overall configuration of a liquid crystal display device according to an embodiment of the present invention.

FIG. 1 is a block diagram showing the overall configuration of a liquid crystal display device 300 according to an embodiment of the present invention. This liquid crystal display device 300 includes a video signal line driving circuit 31, a scanning signal line driving circuit 32, a display panel 34, and a display control circuit 36. Inside the display panel 34, a plurality of scanning signal lines GL1 to GLm and a plurality of video signal lines SL1 to SLn are disposed in a lattice arrangement. Display elements 33 are provided in correspondence with intersections of the plurality of scanning signal lines GL1 to GLm and the video signal lines SL1 to SLn. Single pixel formation portions 37 are constituted by the individual display elements 33 and a liquid crystal layer, for example. Each of the pixel formation portions 37 is provided with a pixel capacitance, which holds a voltage representing the pixel value of that pixel. The scanning signal lines GL1 to GLm are connected to the scanning signal line driving circuit 32, whereas the video signal lines SL1 to SLn are connected to the video signal line driving circuit 31. It should be noted that the display device 300 that is described here is provided with m scanning signal lines and n video signal lines. Also, the driving method in this embodiment is 2-line dot inversion driving.

The display control circuit 36 receives image data Dv representing image information, as well as a clock signal CK, a horizontal synchronization signal Hsyn and a vertical synchronization signal Vsyn for timing from a signal source arranged outside of the liquid crystal display device 300, and outputs a gate output control signal Cg for controlling the scanning signal line driving circuit 32, a source output control circuit Cs for controlling the video signal line driving circuit 31, and a video signal DAT representing image information. The scanning signal line driving circuit 32 receives the gate output control signal Cg that is outputted by the display control circuit 36, and outputs a scanning signal to each of the scanning signal lines GL1 to GLm. The video signal line driving circuit 31 receives the source output control signal Cs outputted by the display control circuit 36, and outputs a video signal (referred to as "driving video signal" in the following) for displaying the image on the display panel 34 to each of the video signal lines SL1 to SLn. Thus, by outputting scanning signals from the scanning signal line driving circuit 32 and outputting driving video signals from the video signal line driving circuit 31, a voltage corresponding to the driving video signal is applied to each of the pixel formation portions 37, and the desired image is displayed.

Figure 2:
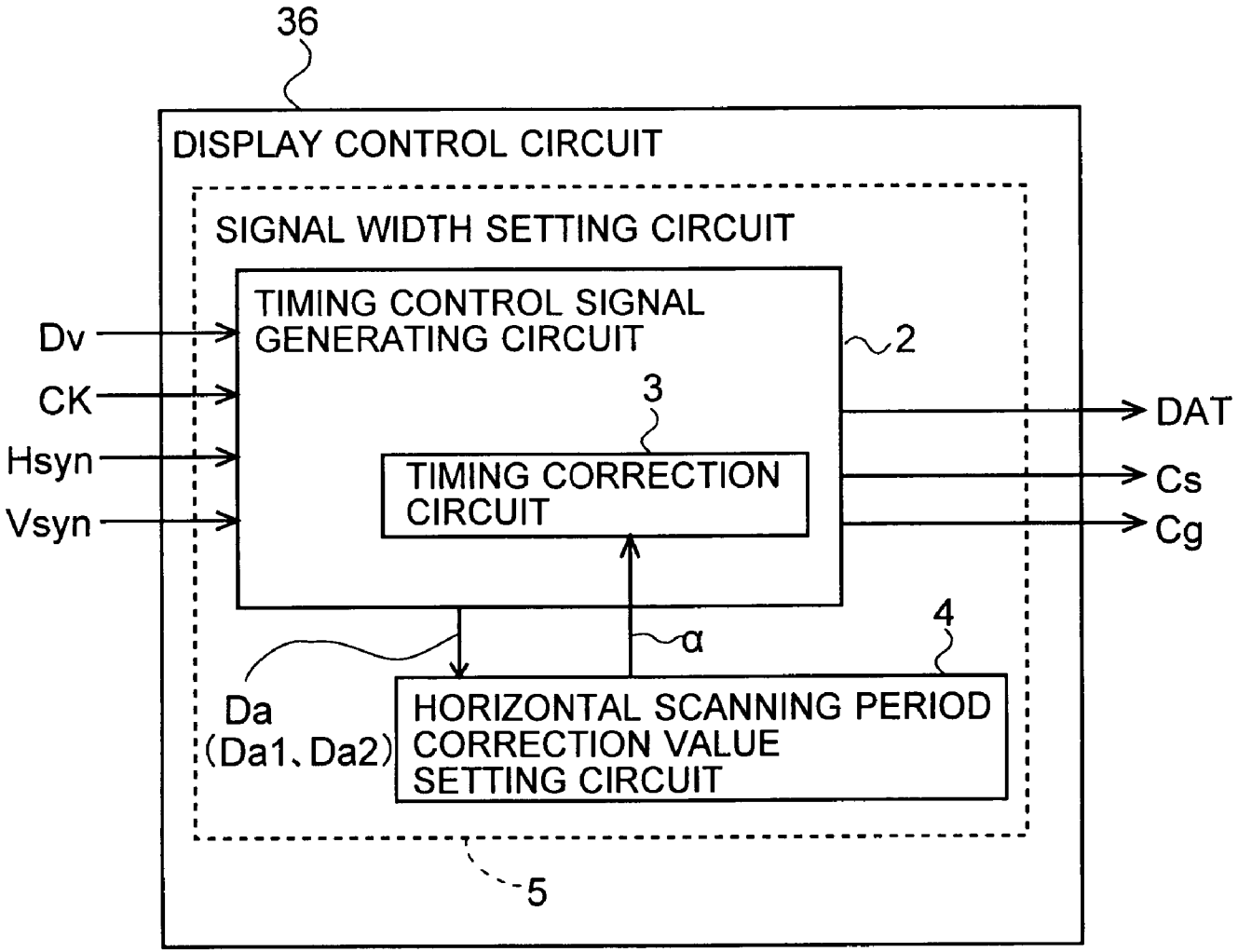
FIG. 2 is a block diagram illustrating the detailed configuration of the display control circuit according to the above-noted embodiment.

FIG. 2 is a block diagram illustrating the detailed configuration of the display control circuit 36 according to the present embodiment. This display control circuit 36 includes a timing control signal generating circuit 2 and a horizontal scanning period correction value setting circuit (signal width correction value generating circuit) 4. The timing control signal generating circuit 2 further includes a timing correction circuit 3. The timing control signal generating circuit 2 receives the image data Dv, the clock signal CK, the horizontal synchronization signal Hsyn and the vertical synchronization signal Vsyn, and outputs an image signal Da representing the display image, and a video signal DAT to be supplied to the video signal line driving circuit 31. The horizontal scanning period correction value setting circuit 4 receives the image signal Da that is outputted from the timing control signal generating circuit 2 in form of an image signal Da1 representing the display image of the pixel formation portions 37 of a polarity-inverted line and an image signal Da2 representing the display image of the pixel formation portions 37 of the next row, and outputs a signal width correction value α for setting the signal width of the driving video signals supplied to the pixel formation portions 37 of these two rows. The timing correction circuit 3 receives the signal width correction value α and outputs the source output control signal Cs and the gate output control signal Cg. It should be noted that the timing control signal generating circuit 2, the timing correction circuit 3 and the horizontal scanning period correction value setting circuit 4 together constitute a signal width setting circuit 5.

2. Generation of Correction Width

If the length of each horizontal scanning period is short and the length of a first horizontal scanning period is equal to the length of a second horizontal scanning period, then the charge ratio of the pixel formation portions 37 in polarity-inverted lines is lower than the charge ratio of the pixel formation portions 37 in polarity-sustained lines. Thus, in the present embodiment, the signal width of the driving video signal in each horizontal scanning period is corrected with the signal width correction value α (which is set as described below), so that the signal width of the driving video signal in the first horizontal scanning period becomes longer than the signal width of the driving video signal in the second horizontal scanning period.

Figure 3:
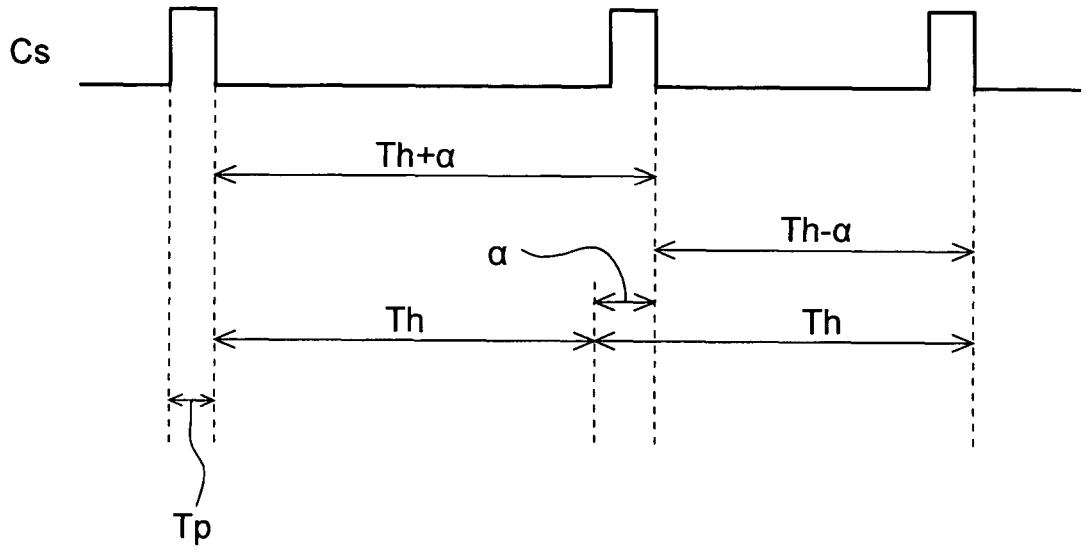
FIG. 3 is a diagram illustrating the correction of the signal width of the driving video signal in the above-noted embodiment.

The following is an explanation of the setting of the signal width correction value α for setting the signal width of the driving video signal in each horizontal scanning period. FIG. 3 is a diagram illustrating the correction of the signal width of the driving video signal. In FIG. 3, a single conventional horizontal scanning period is marked as "Th". When operating this liquid crystal display device, the image signal Da1 representing the display image of the pixel formation portions 37 of a given polarity-inverted line and the image signal Da2 representing the display image of pixel formation portions 37 of the following row are inputted into the horizontal scanning period correction value setting circuit 4. The horizontal scanning period correction value setting circuit 4 compares the signal voltage (first target pixel voltage) represented by the image signal Da1 and the signal voltage (second target pixel voltage) represented by the image signal Da2. The signal width correction value α is determined such that if taking "Th+α" as the length of the first horizontal scanning period (first signal width) and "Th−α" as the length of the second horizontal scanning period (second signal width), the charge ratio of the pixel formation portions 37 of the polarity-inverted line becomes the same as the charge ratio of the pixel formation portions 37 of the polarity-sustained line. This signal width correction value α is outputted from the horizontal scanning period correction value setting circuit 4 and inputted into the timing correction circuit 3. As explained below, the timing correction circuit 3 generates the source output control signal Cs based on this signal width correction value α. It should be noted that the pulse width of the source output control signal Cs is shown by the reference symbol "Tp".

Figure 4:
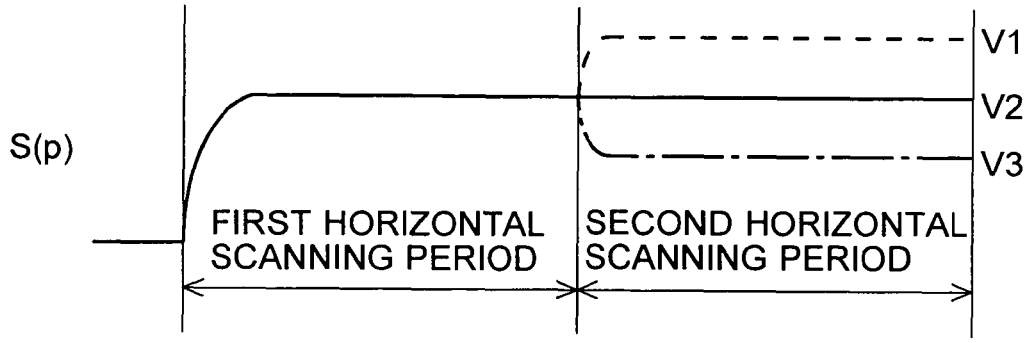
FIG. 4 is a signal waveform diagram illustrating how the signal width correction value is set in the above-noted embodiment.

FIG. 4 is a diagram illustrating how the signal width correction value α is set. In FIG. 4, as for the target voltage of the video signal S(p) in the second horizontal scanning period, a target voltage that is higher than in the first horizontal scanning period is denoted as "V1", a target voltage that is the same as in the first horizontal scanning period is denoted as "V2", and a target voltage that is lower than in the first horizontal scanning period is denoted as "V3". A voltage whose polarity is inverted at every frame period is applied to each of the pixel formation portions 37. Consequently, if the voltage of the video signal S(p) is positive, as shown in FIG. 4, the potential of the polarity-sustained pixels is raised from a negative potential to the target voltage at the second horizontal scanning period. Here, the time until the potential of the polarity-sustained pixels reaches the target value is longer when the target voltage in the second horizontal period is "V1" than when it is "V2", and shorter when the target voltage in the second horizontal period is "V3" than when it is "V2". Therefore, if the second horizontal scanning period is set to a constant length regardless of the difference between the target voltage in the first horizontal scanning period and the target voltage in the second horizontal scanning period, then a difference in the charge ratios of the pixel formation portions 37 occurs in accordance with the difference of the target voltage in the first horizontal scanning period and the target voltage in the second horizontal scanning period. To address this problem, in the present embodiment, the ratio between the length of the first horizontal scanning period and the length of the second horizontal scanning period is set in accordance with the difference between the target voltage in the first horizontal scanning period and the target voltage in the second horizontal scanning period, such that the charge ratio of each of the pixel formation portions 37 is maintained constant. More precisely, the signal width correction value $\alpha$ is set to a lower value when the target voltage in the second horizontal scanning period is "V1" than when it is "V2". Conversely, the signal width correction value $\alpha$ is set to a higher value when the target voltage in the second horizontal scanning period is "V3" than when it is "V2". Also, this signal width correction value $\alpha$ is set for each polarity-inverted line individually.

3. Generation of Control Signal

Figures 5A, 5B, 5C:
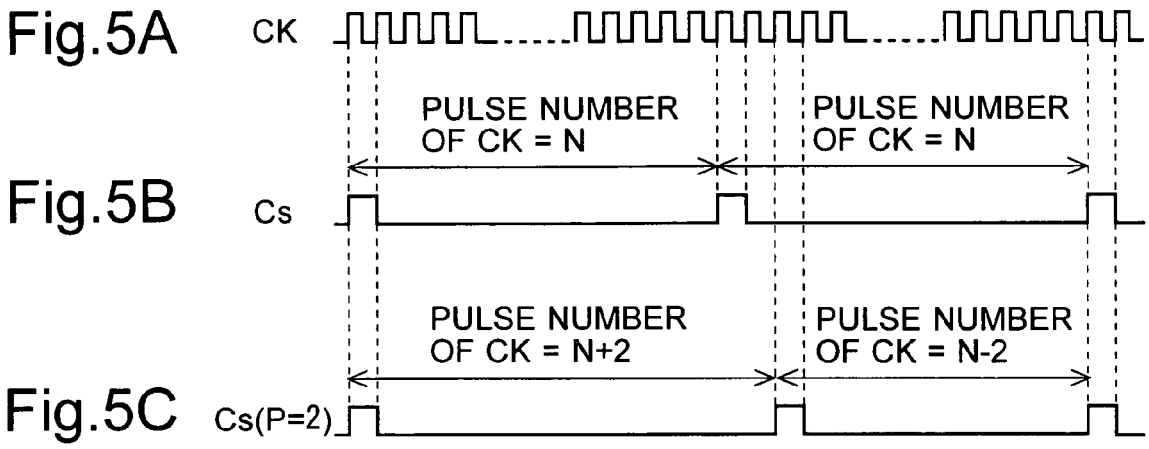
FIGS. 5A to 5C are diagrams illustrating the generation of the source output control signal in the above-noted embodiment.

FIGS. 5A to 5C are diagrams illustrating the generation of the source output control signal Cs in the present embodiment. The driving method in the present embodiment is 2-line dot inversion driving, and the length of the time for two horizontal scanning periods is held constant with the clock signal CK that is inputted into the timing correction circuit 3. As shown in FIG. 5B, when the length of the first horizontal scanning period and the length of the second horizontal scanning period are set to the same length, one pulse of the source output control signal Cs is generated for every N pulses of the clock signal CK. In the present embodiment, the period for which the scanning signal is held in the active state and the signal width of the driving video signal are determined based on the intervals in which the pulses of the source output control signal Cs are generated. Thus, the intervals in which the pulses of the source output control signal Cs are generated are corrected by the timing correction circuit 3 with the signal width correction value $\alpha$ in the following manner.

When the timing correction circuit 3 receives the signal width correction value $\alpha$, the timing correction circuit 3 generates a pulse of the source output control signal Cs at the pulse generation time of the (N+P)-th pulse of the clock signal CK from the time of polarity inversion of the driving video signal, based on the number "P" of correction pulses, which is the number of pulses of the clock signal CK that corresponds to this signal width correction value $\alpha$. And at the pulse generation time of the (N−P)-th pulse of the clock signal CK from the time of this pulse generation, the timing correction circuit 3 again generates a pulse of the source output control signal Cs. For example, if the correction pulse number P corresponding to the signal width correction value $\alpha$ is "2", then a source output control signal with the waveform shown in FIG. 5C is generated.

4. Generation of Driving Video Signal and Scanning Signal

The following is an explanation of the generation of the driving video signal and the scanning signal. As noted above, the timing correction circuit 3 generates a source output control signal Cs whose pulse generation intervals have been corrected. The pulse generation intervals "Th+$\alpha$" and "Th−$\alpha$" of this source output control signal Cs are repeated in alternation as shown in FIG. 3. The thusly generated source output control signal Cs is inputted into the video signal line driving circuit 31. Moreover, in this embodiment, a gate output control signal Cg having the same waveform as the source output control signal Cs is inputted into the scanning signal line driving circuit 32.

Figures 6A, 6B, 6C, 6D, 6E, 6F, 6G, 6H:
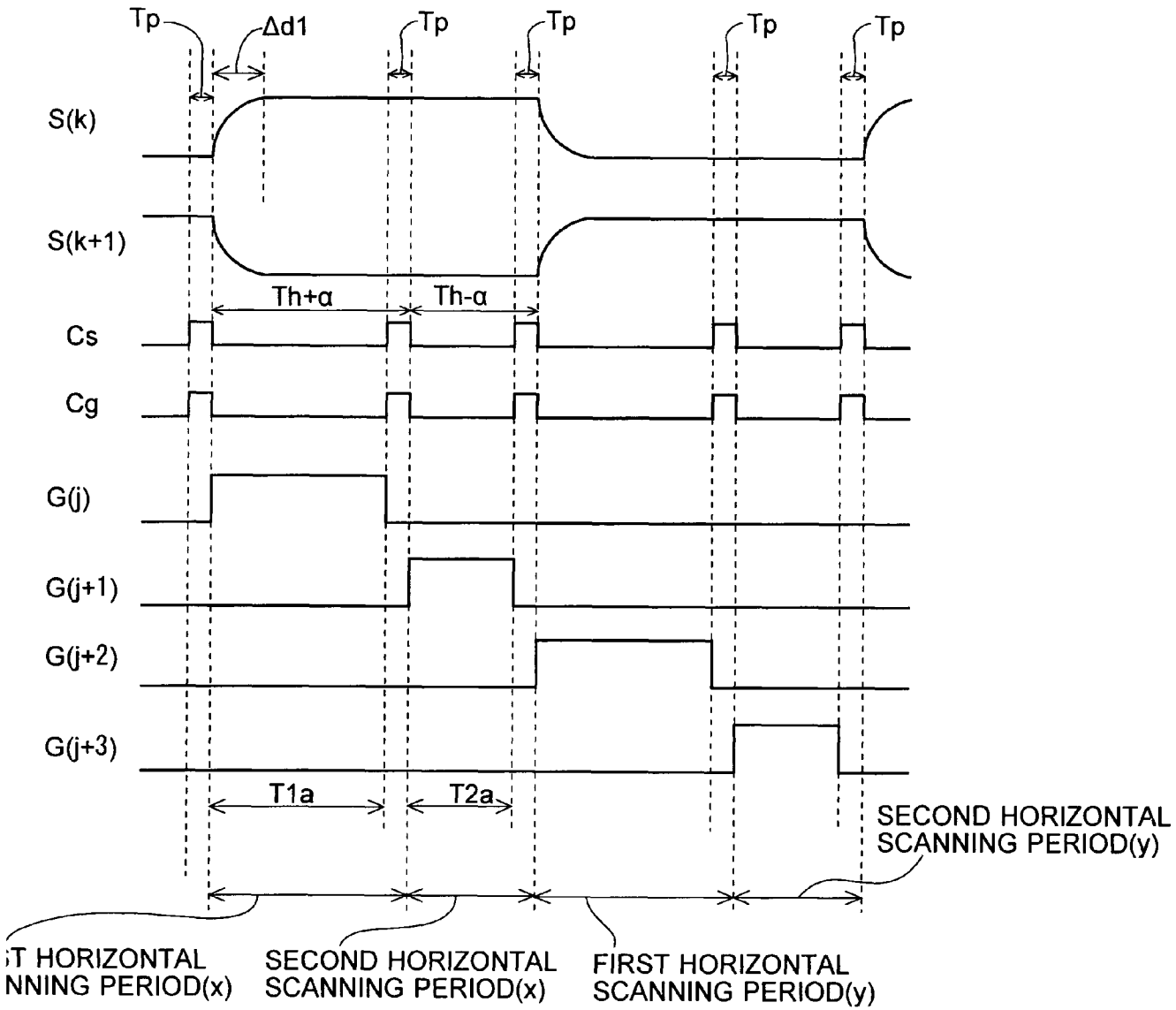
FIGS. 6A to 6H are signal waveform diagrams for the case that the entire screen displays the same luminance in the above-noted embodiment.

FIGS. 6A to 6H are signal waveform diagrams for the case that the entire screen displays the same luminance in the present embodiment. FIG. 6A shows the signal waveform of the driving video signal S(k) of the k-th column. FIG. 6B shows the signal waveform of the driving video signal S(k+1) of the (k+1)-th column. FIG. 6C shows the signal waveform of the source output control signal Cs. FIG. 6D shows the signal waveform of the gate output control signal Cg. FIG. 6E shows the signal waveform of the scanning signal G(j) of the j-th row. FIG. 6F shows the signal waveform of the scanning signal G(j+1) of the (j+1)-th row. FIG. 6G shows the signal waveform of the scanning signal G(j+2) of the (j+2)-th row. FIG. 6H shows the signal waveform of the scanning signal G(j+3) of the (j+3)-th row. For convenience's sake, the horizontal scanning periods from the first to the fourth horizontal scanning period are referred to as "first horizontal scanning period (x)", "second horizontal scanning period (x)", "first horizontal scanning period (y)", and "second horizontal scanning period (y)".

Taking note of the first horizontal scanning period (x), the output of the driving video signal S(k) starts with the falling of the pulse of the source output control signal Cs. At this time, the polarity of the driving video signal S(k) is inverted from the polarity of the previous horizontal scanning period. After the period "Th+c$\alpha$−Tp" has elapsed after starting the output of the driving video signal S(k) in the first horizontal scanning period (x), a pulse of the source output control signal Cs is outputted. Then, when this pulse of the source output control signal Cs has fallen, the output of the driving video signal S(k) in the second horizontal scanning period (x) starts. Consequently, the driving video signal S(k) in the first horizontal scanning period (x) is outputted continuously for the period "Th+$\alpha$". Also, the driving video signal S(k) in the second horizontal scanning period (x) has the same polarity as the driving video period S(k) in the first horizontal scanning period (x).

After the period "Th−$\alpha$−Tp" has elapsed after starting the output of the driving video signal S(k) in the second horizontal scanning period (x), a pulse of the source output control signal Cs is outputted. Then, when this pulse of the source output control signal Cs has fallen, the output of the driving video signal S(k) in the first horizontal scanning period (y) starts. Consequently, the driving video signal S(k) in the second horizontal scanning period (x) is outputted continuously for the period "Th−$\alpha$". Also, since the driving method of the present embodiment is 2-line dot driving, the polarity of the driving video period S(k) in the first horizontal scanning period (y) is inverted from the polarity of the driving video period S(k) in the second horizontal scanning period (x).

As for the driving video signal S(k+1) of the (k+1)-th column, the output at each horizontal scanning period starts at the same timing as for the driving video signal S(k) of the (k)-th column. Also, the polarity of the driving video signal S(k+1) of the (k+1)-th column is opposite to the polarity of the driving video signal S(k) of the (k)-th column.

Referring to FIGS. 6D to 6H, the following is an explanation of the generation of the scanning signals G(j) to G(j+3)

with the scanning signal line driving circuit 32. When generating the pulses of the gate output control signal Cg, every time the pulse falls, the scanning signal becomes active. The scanning signal continues to be active until the next pulse of the gate output control signal Cg rises. Taking note of the first horizontal scanning period (x), the scanning signal G(j) of the j-th row becomes active with the falling of the pulse of the gate output control signal Cg. After the period "Th+α−Tp" has elapsed from the time when the scanning signal G(j) has become active, the next pulse of the gate output control signal Cg rises, and the scanning signal G(j) falls. Then, when this pulse of the gate output control signal Cg falls, the scanning signal G(j+1) of the (j+1)-th row becomes active. Then, after the period "Th−α−Tp" has elapsed, the next pulse of the gate output control signal Cg rises, and the scanning signal G(j+1) of the (j+1)-th row falls. Thereafter, the scanning signals G(j+2) and G(j+3) successively become active.

5. Operation

The following is an explanation of the operation of the present embodiment. Let us have another take note of the driving video signal S(k) of the k-th column in FIG. 6A. The driving video signal S(k) in the first horizontal scanning period (x) has negative polarity at the time when it starts to rise (at the charge start time). Therefore, the time Δd1 elapses from the charge start time until the voltage of the driving video signal S(k) reaches the target voltage. On the other hand, for the driving video signal S(k) in the second horizontal scanning period (x), the target voltages and the polarities of the first horizontal scanning period and second horizontal scanning period are the same, so that the voltage of the driving video signal S(k) has already reached the target voltage at the charge start time. Here, the length of the horizontal scanning periods is corrected by the signal width correction value α, as noted above. As a result, the charge time T1*a* in the first horizontal scanning period (x) becomes "Th+α−Tp" and the charge time T2*a* in the second horizontal scanning period (x) becomes "Th−α−Tp". That is to say, the charge time in the second horizontal scanning period is shorter than the charge time in the first horizontal scanning period.

FIGS. 7A to 7H are signal waveform diagrams for the case that different luminances are displayed at each scanning signal line. Also in this case, the time Δd1 elapses from the charge start time until the voltage of the driving video signal S(k) in the first horizontal scanning period (x) has reached the target voltage. On the other hand, regarding the driving video signal S(k) in the second horizontal scanning period (x), the target voltage in the first horizontal scanning period is different from the target voltage in the second horizontal scanning period, so that different to FIG. 6A, the time Δd2 elapses from the charge start time until the voltage of the driving video signal S(k) reaches the target voltage. Also in this case, the charge time T1*b* in the first horizontal scanning period (x) becomes "Th+α−Tp" and the charge time T2*b* of the second horizontal scanning period (x) becomes "Th−α−Tp". However, as explained above, the signal width correction value α is set in accordance with the difference between the target voltage in the first horizontal scanning period and the target voltage in the second horizontal scanning period, so that the length of the charge time T1*a* in the first horizontal scanning period (x) when the entire screen displays the same luminance will be different from the charge time T1*b* in the first horizontal scanning period (x) when the luminance differs from scanning signal line to scanning signal line. Similarly, the length of the charge time T2*a* in the second horizontal scanning period (x) when the entire screen displays the same luminance will be different from the charge time T2*b* in the second horizontal scanning period (x) when the luminance differs from scanning signal line to scanning signal line.

6. Advantageous Effect

As explained above, in the present embodiment, a source output control signal and a gate output control signal are generated, whose pulse generation intervals are set based on the video signals to be supplied to the pixel formation portions. These pulse generation intervals are set to be longer for the charge times of polarity-inverted pixels than for the charge times of polarity-sustained pixels. Also, the charge times of the polarity-sustained pixels are set in accordance with the difference between the signal voltage representing the display image of the polarity-inverted pixels and the signal voltage representing the display image of the polarity-sustained pixels. Moreover, the driving video signal supplied to the pixel formation portions is generated based on the source output control signal and the scanning signal is generated based on the gate output control signal. Therefore, the time for which the driving video signal is supplied is longer for the polarity-inverted pixels than for the polarity-sustained pixels. Also, the ratio between the time for which the driving video signal is supplied to the polarity-inverted pixels and the time for which the driving video signal is supplied to the polarity-sustained pixels is set in accordance with the display image. The rising time of the driving video signal is longer for polarity-inverted pixels than for polarity-sustained pixels, but with the above-described operation, the difference of the charge ratios between polarity-inverted pixels and polarity-sustained pixels is compensated in accordance with the display image. Thus, decreases of the display quality caused by differences in the charge ratios between polarity-inverted pixels and polarity-sustained pixels can be overcome.

7. Modified Examples

Figure 8:
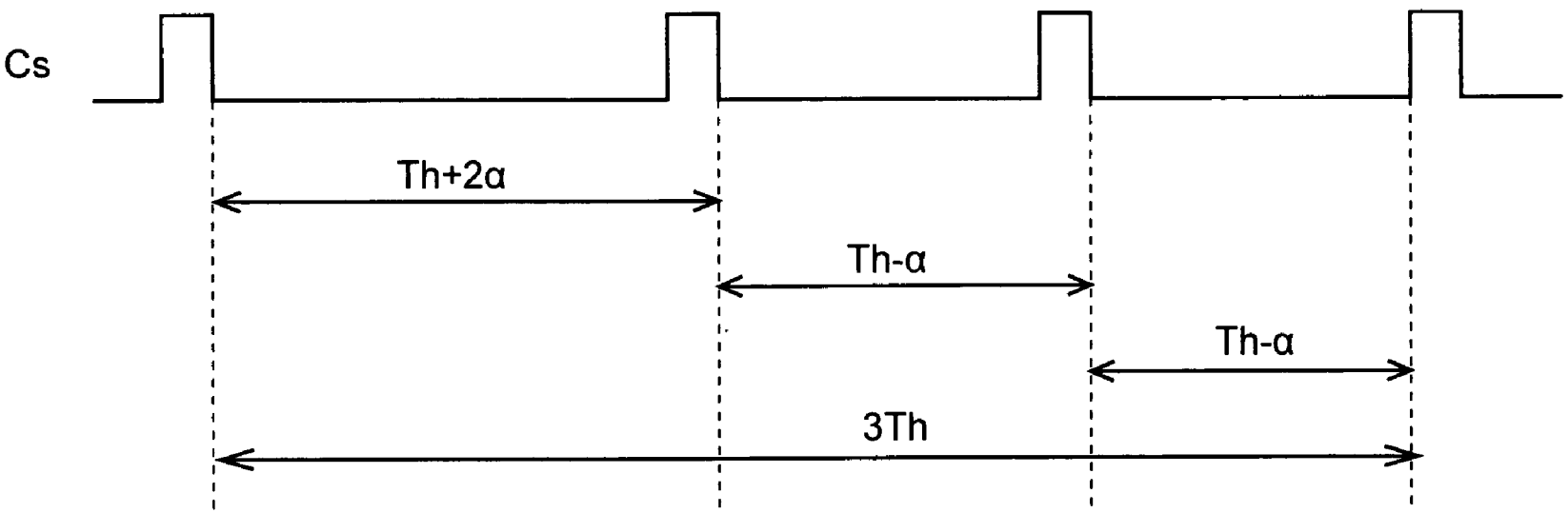
FIG. 8 is a diagram illustrating the correction of the signal width of the driving video signals in a modified example.

In the foregoing embodiment, an example was explained in which the driving method is 2-line dot inversion driving, but the present invention is not limited to this. As for the signal width of the driving video signal, in the above embodiment, the signal width in the first horizontal scanning period and the signal width in the second horizontal scanning period are set based on the signal width correction value α, which is determined by the horizontal scanning period correction value setting circuit 4, but the present invention can also be applied to multiple line dot inversion driving of three lines or more, by setting the signal width from the third horizontal scanning period onward to the same width as the signal width in the second horizontal scanning period. For example, when the driving method is 3-line dot inversion driving, the length of the first horizontal scanning period is set to "Th+2α", and the lengths of the second horizontal scanning period and of the third horizontal scanning period are set to "Th−α", as shown in FIG. 8. Furthermore, the present invention is not limited to dot inversion driving, and can be also applied to multiple-line inversion driving, such as 2-line inversion driving.

Figure 9:
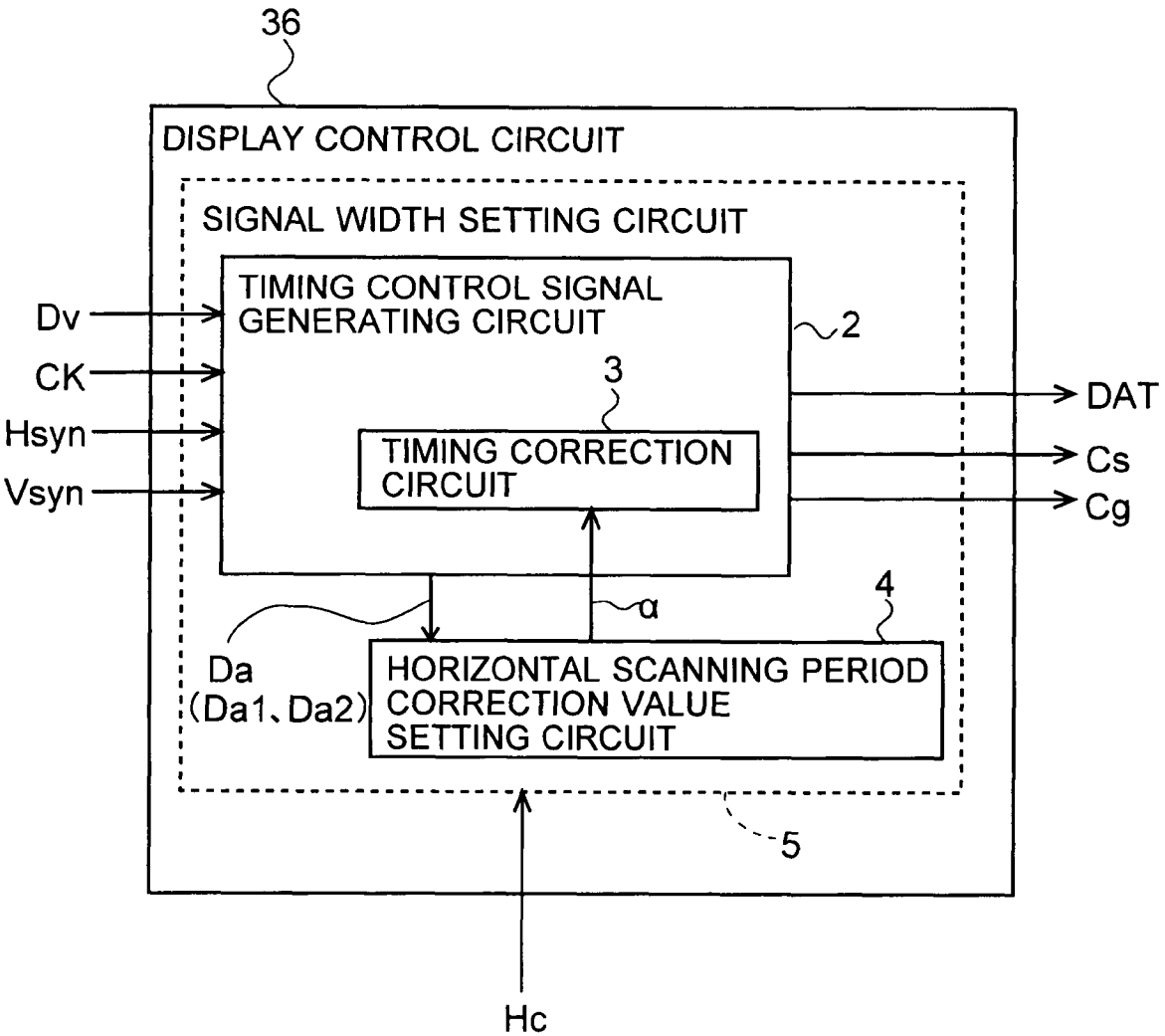
FIG. 9 is a block diagram showing the detailed configuration of the display control circuit in the modified example.
Figures 11A, 11B, 11C, 11D, 11E:
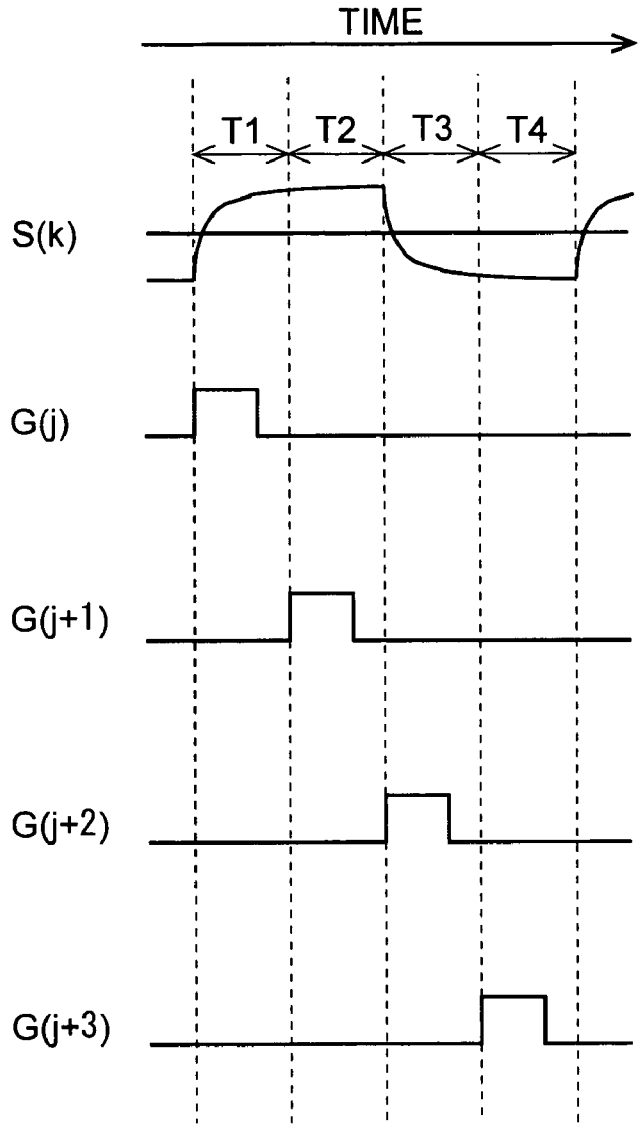
Fig.11A PRIOR ART
Fig.11B PRIOR ART
Fig.11C PRIOR ART
Fig.11D PRIOR ART
Fig.11E PRIOR ART
FIGS. 11A to 11E are signal waveform diagrams of the video signals and the scanning signals for the case of 2-line dot inversion driving in a conventional liquid crystal display device.

Also, in the above embodiment, the signal width correction value α is determined only by the image data Dv applied from outside, but the present invention is not limited to this. For example, as shown in FIG. 9, it is also possible that a correction width control signal Hc is received from outside, and the signal width correction value α is set in accordance with this correction width control signal Hc. With this configuration, by inputting information representing, for example, the characteristics of the panel of the liquid crystal display device as the correction width control signal Hc, it is possible to set the signal width correction value α in consideration of such characteristics. Moreover, by inputting information representing a temperature detected by a temperature sensor as the correction width control signal Hc, it is possible to set the signal width correction value α based on this temperature. The lower the temperature is, the longer the rise time of the driving video signal and the lower the charge ratio of the pixel formation portions, but with this modified example, the length of the first horizontal scanning period and the length of the second horizontal scanning period are set to suitable lengths in accordance with the temperature. Thus, differences in the charge ratios between the pixel formation portions are compensated regardless of temperature, and decreases of the display quality can be suppressed.

While the invention has been described in detail, the foregoing description is in all aspects illustrative and not restrictive. It is understood that numerous other modifications and variations can be devised without departing from the scope of the invention.

What is claimed is:

1. A driving circuit of an active matrix liquid crystal display device comprising a plurality of video signal lines for transmitting a plurality of video signals representing an image to be displayed, a plurality of scanning signal lines intersecting the plurality of video signal lines, and a plurality of pixel formation portions that are arranged in a matrix in correspondence with intersections of the plurality of video signal lines and the plurality of scanning signal lines, the driving circuit comprising:

a video signal line driving circuit for supplying the video signals to the plurality of video signal lines such that, within a single frame period, the polarities of voltages applied to the pixel formation portions are inverted at every predetermined number of scanning signal lines, the predetermined number being at least 2;

a scanning signal line driving circuit for selectively driving the plurality of scanning signal lines; and a signal width setting circuit for setting a first signal width representing a period during which an output of the video signals is used to charge one pixel formation portion when an active scanning signal is supplied to a first scanning signal line of the predetermined number of scanning signal lines and a second signal width representing a period during which an output of the video signals is used to charge one pixel formation portion when an active scanning signal is supplied to a second or further scanning signal line of the predetermined number of scanning signal lines;

wherein the video signal line driving circuit generates the video signals based on the first signal width and the second signal width;

wherein the scanning signal line driving circuit generates a scanning signal that becomes active in accordance with the first signal width and the second signal width;

wherein the first signal width is set to a larger width than the second signal width;

wherein the signal width setting circuit sets the first signal width and the second signal width dynamically based on a measured difference between a first target pixel voltage and a second target pixel voltage during the output of the video signals;

wherein the signal width setting circuit generates the first and second target pixel voltages based on image data corresponding to the pixel formation portions of the first scanning signal line and the second or further scanning signal line;

wherein the signal width setting circuit generates the first target pixel voltage based on image data corresponding to the pixel formation portions of the first scanning signal line; and wherein the signal width setting circuit generates the second target pixel voltage based on image data corresponding to the pixel formation portions of the second or further scanning signal line.

2. The driving circuit according to claim 1, wherein the signal width setting circuit sets the first signal width and the second signal width such that a ratio of the pixel voltage at the pixel formation portions arranged in correspondence with the intersections of the first scanning signal line and the plurality of video signal lines to the first target pixel voltage, which is a pixel voltage taken as a target, when an active scanning signal is supplied to the first scanning signal line, is equal to a ratio of the pixel voltage at the pixel formation portions arranged in correspondence with the intersections of the second and further scanning signal lines and the plurality of video signal lines to the second target pixel voltage, which is a pixel voltage taken as a target, when an active scanning signal is supplied to the second and further scanning signal lines.

3. The driving circuit according to claim 1, further comprising:

a signal width correction value generating circuit for generating a signal width correction value for setting the first signal width and the second signal width based on a predetermined input signal;

wherein the signal width setting circuit sets the first signal width and the second signal width based on the signal width correction value.

4. An active matrix liquid crystal display device comprising:

a plurality of video signal lines for transmitting a plurality of video signals representing an image to be displayed;

a plurality of scanning signal lines intersecting the plurality of video signal lines;

a plurality of pixel formation portions that are arranged in a matrix in correspondence with intersections of the plurality of video signal lines and the plurality of scanning signal lines;

a video signal line driving circuit for supplying the video signals to the plurality of video signal lines such that, within a single frame period, the polarities of voltages applied to the pixel formation portions are inverted at every predetermined number of scanning signal lines, the predetermined number being at least 2;

a scanning signal line driving circuit for selectively driving the plurality of scanning signal lines; and a signal width setting circuit for setting a first signal width representing a period during which an output of the video signals is used to charge one pixel formation portion when an active scanning signal is supplied to a first scanning signal line of the predetermined number of scanning signal lines and a second signal width representing a period during which an output of the video signals is used to charge one pixel formation portion when an active scanning signal is supplied to a second or further scanning signal line of the predetermined number of scanning signal lines;

wherein the video signal line driving circuit generates the video signals based on the first signal width and the second signal width;

wherein the scanning signal line driving circuit generates a scanning signal that becomes active in accordance with the first signal width and the second signal width;

wherein the first signal width is set to a larger width than the second signal width;

wherein the signal width setting circuit sets the first signal width and the second signal width dynamically based on a measured difference between a first target pixel voltage and a second target pixel voltage during the output of the video signals;

wherein the signal width setting circuit generates the first target pixel voltage based on image data corresponding to the pixel formation portions of the first scanning signal line; and wherein the signal width setting circuit generates the second target pixel voltage based on image data corresponding to the pixel formation portions of the second or further scanning signal line.

5. The display device according to claim 4, wherein the signal width setting circuit sets the first signal width and the second signal width such that a ratio of the pixel voltage at the pixel formation portions arranged in correspondence with the intersections of the first scanning signal line and the plurality of video signal lines to the first target pixel voltage, which is a pixel voltage taken as a target, when an active scanning signal is supplied to the first scanning signal line, is equal to a ratio of the pixel voltage at the pixel formation portions arranged in correspondence with the intersections of the second and further scanning signal lines and the plurality of video signal lines to the second target pixel voltage, which is a pixel voltage taken as a target, when an active scanning signal is supplied to the second and further scanning signal lines.

6. The display device according to claim 4, further comprising:

a signal width correction value generating circuit for generating a signal width correction value for setting the first signal width and the second signal width based on a predetermined input signal;

wherein the signal width setting circuit sets the first signal width and the second signal width based on the signal width correction value.

7. A driving method for an active matrix liquid crystal display device comprising a plurality of video signal lines for transmitting a plurality of video signals representing an image to be displayed, a plurality of scanning signal lines intersecting the plurality of video signal lines, and a plurality of pixel formation portions that are arranged in a matrix in correspondence with intersections of the plurality of video signal lines and the plurality of scanning signal lines, the driving method comprising:

a video signal line driving step of supplying the video signals to the plurality of video signal lines such that, within a single frame period, the polarities of voltages applied to the pixel formation portions are inverted at every predetermined number of scanning signal lines, the predetermined number being at least 2;

a scanning signal line driving step of selectively driving the plurality of scanning signal lines; and a signal width setting step of setting a first signal width representing a period during which an output of the video signals is used to charge one pixel formation portion when an active scanning signal is supplied to a first scanning signal line of the predetermined number of scanning signal lines and a second signal width representing a period during which an output of the video signals is used to charge one pixel formation portion when an active scanning signal is supplied to a second or further scanning signal line of the predetermined number of scanning signal lines;

wherein the video signals are generated based on the first signal width and the second signal width;

wherein the scanning signals are generated based on the first signal width and the second signal width;

wherein the first signal width is set to a larger width than the second signal width;

wherein the signal width setting step sets the first signal width and the second signal width dynamically based on a measured difference between a first target pixel voltage and a second target pixel voltage during the output of the video signals;

wherein the signal width setting step generates the first target pixel voltage based on image data corresponding to the pixel formation portions of the first scanning signal line; and wherein the signal width setting step generates the second target pixel voltage based on image data corresponding to the pixel formation portions of the second or further scanning signal line.

8. The driving method according to claim 7, wherein the first signal width and the second signal width are set such that a ratio of the pixel voltage at the pixel formation portions arranged in correspondence with the intersections of the first scanning signal line and the plurality of video signal lines to the first target pixel voltage, which is a pixel voltage taken as a target, when an active scanning signal is supplied to the first scanning signal line, is equal to a ratio of the pixel voltage at the pixel formation portions arranged in correspondence with the intersections of the second and further scanning signal lines and the plurality of video signal lines to the second target pixel voltage, which is a pixel voltage taken as a target, when an active scanning signal is supplied, to the second and further scanning signal lines.

9. The driving method according to claim 7, further comprising;

a signal width correction value generating step of generating a signal width correction value for setting the first signal width and the second signal width based on a predetermined input signal;

wherein the first signal width and the second signal width are set based on the signal width correction value.

* * * * *